United States Patent [19]

Chaudhuri

[11] 4,202,723

[45] May 13, 1980

[54] AUTOMATICALLY CONTROLLED MACHINE FOR MAKING DOUBLE-FACE, POLYMER PLASTIC COATED, CORRUGATED PAPERBOARD

[75] Inventor: Partha S. Chaudhuri, Covington, Va.

[73] Assignee: Westvaco Corporation, New York, N.Y.

[21] Appl. No.: 840,768

[22] Filed: Oct. 11, 1977

Related U.S. Application Data

[62] Division of Ser. No. 758,040, Jan. 10, 1977, Pat. No. 4,071,392.

[51] Int. Cl.[2] ..... B31F 5/00

[52] U.S. Cl. ..... 156/470; 156/555

[58] Field of Search ..... 156/205, 208, 210, 470–473, 156/359; 388/20; 100/163 W, 170; 156/555

[56] References Cited

U.S. PATENT DOCUMENTS

| | | | |
|---|---|---|---|
| 2,900,951 | 8/1959 | Kabelitz | 100/170 X |
| 3,591,436 | 7/1971 | Klein et al. | 156/210 |
| 3,731,620 | 5/1973 | Klemmer | 308/20 X |
| 3,861,057 | 1/1975 | Wittstock | 156/359 U X |
| 4,038,122 | 7/1977 | Delight | 156/210 |
| 4,080,890 | 3/1978 | Dreher | 100/170 |

*Primary Examiner*—David A. Simmons
*Attorney, Agent, or Firm*—W. Allen Marcontell; Richard L. Schmalz

[57] ABSTRACT

A polymer plastic coated paper double-facer corrugating machine equipped with web preheating cylinders having position adjustable wrap control arms is described having a variable response relationship between the machine production speed and a corresponding wrap control arm setting. The double facing nip of the machine is provided with a series coupled pneumatic loading spring and worm jack to set the nip clearance. For transitional support of double faced product between the load variable nip roll and the lower tractor belt of the double-faced board pulling section, an air table is provided.

3 Claims, 5 Drawing Figures

AUTOMATICALLY CONTROLLED MACHINE FOR MAKING DOUBLE-FACE, POLYMER PLASTIC COATED, CORRUGATED PAPERBOARD

This is a division of application Ser. No. 758,040, filed Jan. 10, 1977, now U.S. Pat. No. 4,071,392.

BACKGROUND OF THE INVENTION

1. Field of the Invention

The present invention relates to the fabrication of corrugated board from paper web. Specifically, the present invention relates to the control of wrap guide rollers for web preheating cylinders. Also, a new bonding nip and product pulling section is described having unique value for continuously laminating double faced board from polymer plastic coated paper webs.

2. Description of the Prior Art

In the fabrication of corrugated board from paper webs, it may be desirable to heat one or more of the constituent webs to a predetermined temperature prior to bonding or corrugating.

There are several reasons for web preheating such as that disclosed by K. B. Lord in U.S. Pat. No. 3,004,880 for curl correction and that disclosed by W. P. Sorenson in U.S. Pat. No. 3,694,927 for adhesive cure acceleration. U.S. Pat. No. 3,960,475 to J. Deligt et al describes the use of steam heated cylinders to plasticize a polymer plastic coating on a paper web for fusion bonding a corrugated liner with a corrugated medium web.

Regardless of the objective, when preheating cylinders are used to heat a traveling web, it is desirable, if not necessary, to control the magnitude of web wrap about the cylinder. Since the web path to and from the preheating cylinder is normally fixed, it is conventional to provide a wrap guide roller having an orbital path about the preheating cylinder to adjust the location about the preheating cylinder periphery at which the web first contacts the preheating cylinder surface. Moreover, if more than approximately 200° of preheating cylinder surface is to be made available for effective web heating, it is known to provide two such orbiting wrap guide rollers; the angular location of an outer orbit or secondary wrap control roller having a fixed ratio relationship to an inner orbit or primary wrap control roller.

The K. B. Lord patent, supra, describes a double face corrugated board laminating machine wherein both, the flute tips of prior laminated single face web and the double face liner, are heated by means of preheating cylinders. The Lord patent disclosure also includes an automatic control system for sensing the single face or liner web temperature as the independent control variable immediately prior to entering the double face laminating nip. The angular setting of the Lord wrap control arms respective to each preheating cylinder is determined by a fixed ratio relationship between the actually sensed web temperature and a set-point signal derived from the relative magnitude of finished board curl.

One objective of the present invention is to provide a web preheating cylinder wrap arm control system suitable for bonding 0.008 to 0.010 inch (0.203 mm to 0.254 mm) thick paper web coated with a thin film, 0.001 to 0.00075 inch (0.025 mm to 0.019 mm), of polymer plastic such as polyethylene, polybutylene, buty rubber, polyisobutylene polyvinylbutylene, polymethylmethacrylate, polyvinylchloride, and polyamides. Under this circumstance, no adhesives are used in the laminating process, the respective liner and corrugated medium webs being welded together by thermal fusion of the plastic coatings. The technique requires ±5° F. regulation of the 210° F. fusing temperature for the plastic coat lamina. If overheated, the plastic coat develops pinholes to destroy the moisture barrier effectiveness of the coat. If underheated, poorly fused and weak joints between the liner and the corrugated medium results.

When the number of parametric variables affecting lamination of such plastic coated webs are considered, the relatively simple temperature control feedback system disclosed by the Lord patent is found insufficient. Such variables may include (1) the temperature and flow rate of heating steam to the preheating cylinder, (2) the running speed of the laminating machine, (3) the thickness and/or density of the web. An operational example may be found in a production machine which changes frequently between different web weights. The response ratio between an angular set change in the position of a wrap control roller and a control signal error differential will vary respective to the different web weights due to respective heat transfer characteristics. Similarly, any predetermination of response control ratios presumes the existence of certain fixed operating conditions. Should the heating steam temperature and/or flow rate change, the response ratio will be directly affected.

It is, therefore, another object of the present invention to provide an automatic control system for a preheating cylinder wrap arm having a very short feedback signal interim wherein the signal/mechanical response ratio may be quickly and conveniently adjusted by the machine operator.

An additional object of the present invention is to teach the construction of a double facing fusion nip uniquely valuable in forming double faced corrugated board from polymer plastic coated web.

SUMMARY OF THE INVENTION

These and other objects of the invention to be subsequently made apparent are accomplished by a wrap guide roller control system wherein the machine speed is measured to provide an independent wrap guide arm control signal in a closed loop feedback system wherein the degree of heating wrap the web is given about the preheating cylinder surface is predominately controlled by the machine production speed. Additionally, the machine speed signal is weighted to provide an adjustment capacity in the speed/wrap angle response rate. A temperature signal which reflects the web temperature immediately prior to the junction nip is used to further modify the control result.

The junction roll of a double facer fusion nip is resiliently mounted on pneumatic springs secured to an adjustable base. Fusion nip clearances and pressures may be coordinated by the operator with a combination spring cell pressure and base setting position.

The junction roll interior carries a circulation of chilled water to hasten heat removal from the fused bond between corrugated flute tips and a double face liner web.

Following the junction roll, an air table provided for dynamic, high heat transfer air support to the newly fused double faced board.

BRIEF DESCRIPTION OF THE DRAWING

Relative to the drawing wherein like reference characters designate like or similar elements throughout the several figures of the drawing.

DESCRIPTION OF THE PREFERRED EMBODIMENT

Figure 1:
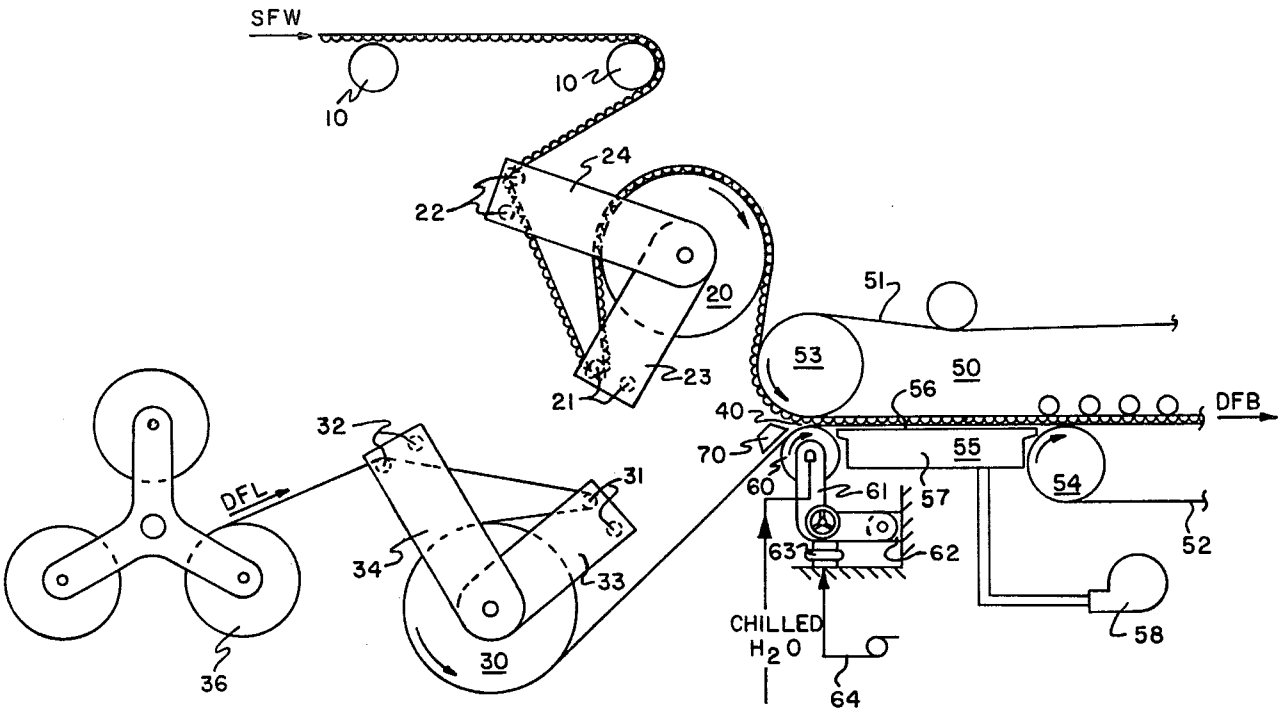
FIG. 1 is a line schematic of a double facing machine constructed in accordance with the present invention.

Relative to the line schematic of FIG. 1, a continuous single faced corrugated web (SFW) is delivered to the double facer apparatus illustrated from a single facing apparatus not shown. The SFW comprises a lamination of two polymer plastic coated paper webs; one web being corrugated with transversely extending flutes and the other web being fused to the flute crests.

A pair of take-up rolls 10 guide the SFW path to the proximity of a preheating cylinder 20. Characteristic of such a preheating cylinder 20 is a hollow shell construction for the circulation of heating steam and a Teflon type of surface coat or treatment is provided to prevent undesirable sticking of the polymer plastic to the bare steel surface of cylinder 20. A representative size for the cylinder 20 may be in the order of 36 inches O.D. (91.44 cm) and 86 inches axial length (218.44 cm).

Orbiting about the periphery of preheating cylinder 20 are two pairs of wrap guide rollers 21 and 22 mounted distally on respective pairs of rotary swing arms 23 and 24. The radially inner set of wrap guide rollers 21 are designated as primary wrap guide rollers whereas the outer set 22 is designated as the secondary wrap guide rollers.

Although journaled about the same rotational axis as cylinder 20, each pair of swing arms 23 and 24 is independently driven to a specified position. However, the drive trains of the two swing arm sets are interlocked by a fixed rotational ratio, 3:1 for example, whereby for each angular position for the primary wrap guides 21 in the operational arc of approximately 250° about cylinder 20, there is a corresponding angular position for the secondary wrap guides 22. This design technique allows an effective wrap arc about the cylinder 20 of greater than 180° without interference in the web flow path.

For greater detail in the drive transmission mechanics of such an arrangement, reference may be taken of the DeLigt et al patent, supra, wherein sprocket and chain transmissions for both swing arm sets are driven from a common motor shaft.

From surface contact with preheating cylinder 20, the SFW is guided into a junction nip 40 of a pulling section 50 where it is joined with the double face liner (DFL) web drawn from a reel supply 36.

Like the SFW, the DFL is heated over a respective preheating cylinder 30 that is identical or very similar to cylinder 20. Also like cylinder 20, the DFL preheating cylinder 30 is provided with primary and secondary wrap guide rollers 31 and 32 distally mounted on rotatable swing arms 33 and 34, respectively.

In the particular embodiment of the invention here described, both sets of wrap guide rolls respective to the two preheating cylinders 20 and 30 are driven from a common motor shaft. Consequently, any action command signal to the common motor will produce simultaneous and identical responses from the two wrap guide sets respective to cylinders 20 and 30.

The pulling section 50 basically comprises upper and lower tractor belts 51 and 52 carried about tail pulleys 53 and 54. The upper tail pulley 53 provides structural rigidity for the top half of junction nip 40.

Lower tail pulley 54 is set back from the junction nip 40 by 12 to 24 inches (30 to 60 cm) to accommodate a transitional support air table 55. This air table 55 is basically a perforated, Teflon coated top surface plate 56 to carry the double faced board (DFB) product fused at the junction nip 40 from the junction nip into the elongated belt nip region between oppositely facing portions of belts 51 and 52.

Beneath the top surface plate 56 of air table 55 is a plenum chamber 57 supplied with low pressure air. An ambient temperature air supply 58 is adequate to accomplish the primary transitional support function of air table 55 but if chilled air, in the order of 40° F. or lower, is supplied, it is possible to eliminate or significantly reduce the length of the pulling section 50.

At the instant of junction between the flute tips of the SFW and the inside face of the DFL a bond is formed. However, this bond is no stronger than the plastic of which is is made at the corresponding temperature. Consequently, the heat in the plastic coating material which was necessary to form the bond must be withdrawn through the DFL web thickness to set the joint with full strength. This, of course, presents a time, heat transfer rate relation to the DFB production rate. A conventional, 50 ft. (15 m) long pulling table is adequate for a 500 fpm (150 mpm) production rate with an ambient air supply to the air table. However, if the air table is supplied with 40° F. chilled air, the pulling table length may be reduced or eliminated according to the production speed.

Junction roll 60, which forms the lower structural support of the junction nip 40, is a hollow cylinder receiving an internal circulation of chilled water, 40° F. for example. Crank arms 61, pivoted at clevis 62, are dynamically supported in the nip loading direction by pneumatic springs 63. Charging the springs 63 is a conveniently adjustable pressure supply system 64 whereby the junction nip load force may be altered. Although not illustrated in detail, it is well known in the resilient suspension arts to connect a relatively large but variable volume pressure tank with the pressurized internal volume of the spring 63. Such variable volume tanks are useful to regulate the totally communicated pressure volume thereby permitting a degree of control over the spring deflection rate in addition to the suspension force.

Figure 2:
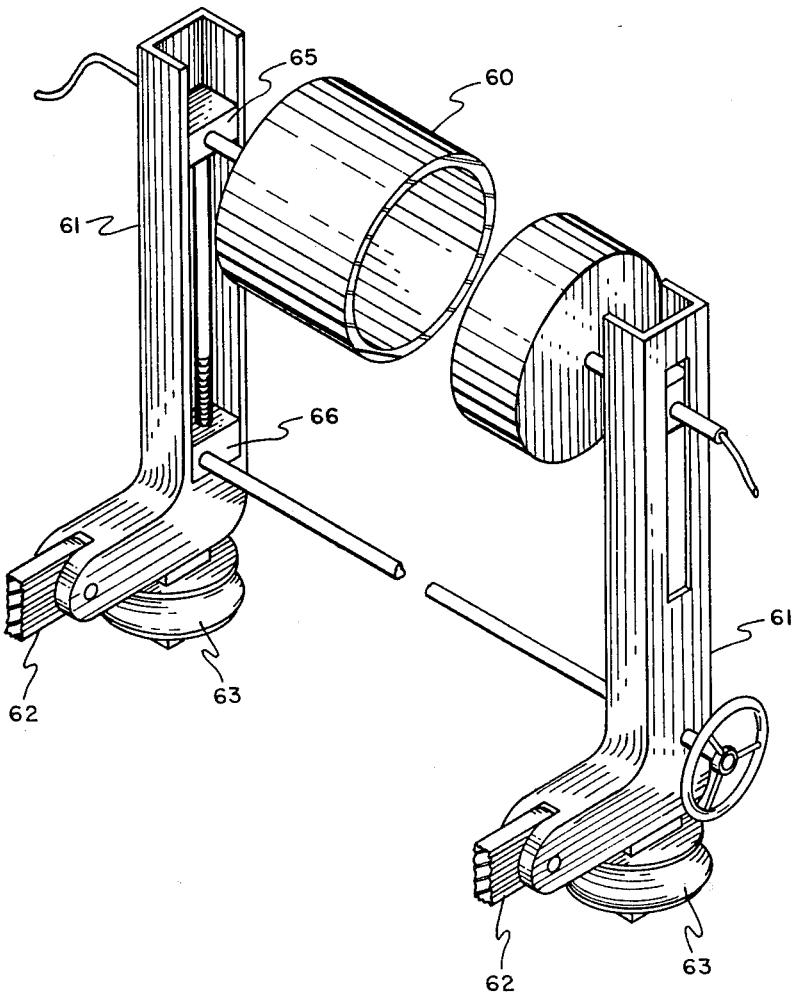
FIG. 2 is an isometric pictorial of the junction roll resilient loading and clearance adjusting mechanism.

In addition, the journals 65 for junction roll 60 are linearly adjustable by a displacement mechanism such as the worm jack 66 of FIG. 2.

A combined manipulation of the series coupled pneumatic spring 63 and worm jack 66 allows the machine operator to adjust the compression force and clearance in the junction nip 40.

Generally, the wrap guide roller control system comprises a basic feedback control loop whereby a signal of variable magnitude proportional to the machine speed is compared to a signal from the roller positioning apparatus of variable magnitude proportional to the actual location of the rollers. The polarity of any difference between the variable speed and position signals dictates the direction of a roll position corrective drive.

The foregoing signal logic presumes a predetermined correlation between the machine speed and the arcuate degree of preheating cylinder wrap which further presumes a correlation between arcuate wrap and nip temperature of the web. While such relationships are predominately present, the degree of variability and error may exceed the allowable temperature fluctuation span for bonding polymer plastic coated paper. Accordingly, provision is made to modify the machine speed signal in either gain or constant bias modes.

Similarly, provision is made to modify the wrap guide roll position signal by a nip temperature constant.

The two modified signals are subsequently compared to derive a corrective command signal to the wrap guide arm drive motor.

Figure 3:
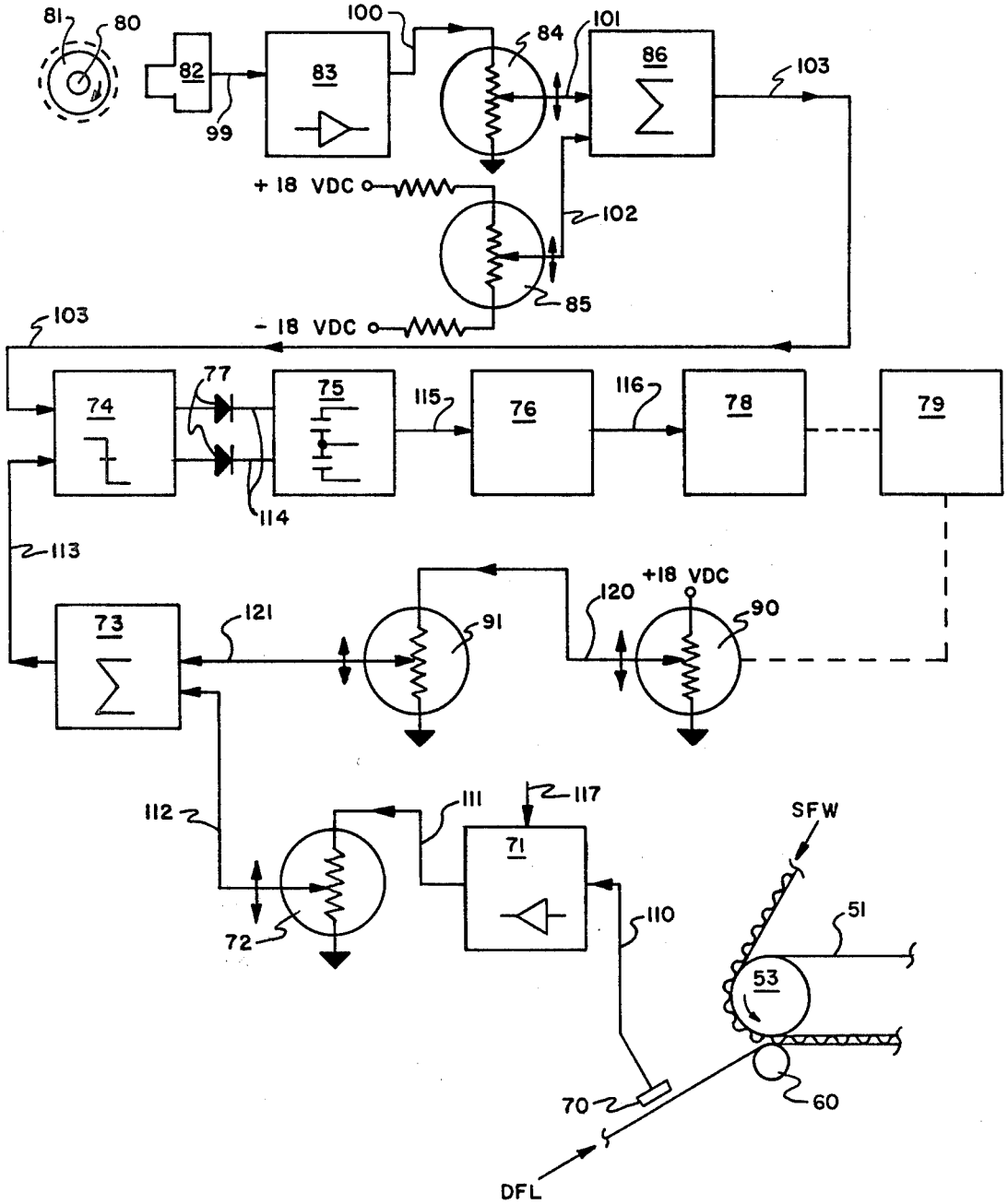
FIG. 3 is a line schematic of the present wrap guide roller control circuit.

To practice this logic strategy shown schematically by FIG. 3, a tachometer signal 100 is generated proportional to the rotational frequency of some primary drive machine element; the line shaft from which the pulling section 50 is driven, for example. A direct gear coupling between the line shaft 80 (FIG. 3) and the head pulleys (not shown) which drive upper and lower tractor belts 51 and 52 (FIG. 1) assures a direct, albeit ratioed, relationship between the web speed and the line shaft rotational frequency.

An appropriate tachometer signal generator may include a sprocket element 81 secured to the line shaft 80 having a pulse generating magnetic pickup head 82 disposed adjacent the tip circle of the sprocket teeth. A fixed number of teeth on the sprocket 81 are distributed uniformly about the circumference thereof.

The significant operational characteristic of the pickup head 82 is to produce a single, momentary electrical pulse for the passage of each sprocket tooth past the pickup head. Accordingly, a pulse 99 is emitted from the pickup head 82 for each predetermined angular segment of a line shaft 80 revolution. For example, a 40 tooth sprocket 81 may produce 24 pulses for each running foot of DFB. At a production rate of 500 fpm, 1200 ppm are generated as signal 99.

The pulses 99 from the pickup head 82 are converted to proportional voltage signals 100 by a frequency/voltage converter 83. The significant operational characteristic of this well known electronic sub-circuit is to pace the incoming pulses 99 against a measured time interval to obtain an objective frequency magnitude and issue a standing potential as signal 100 that proportionately corresponds over a limit scale, 0 to 10 vdc for example, to the pulse frequency which may range from 0 to 200 Hz. Signal 100, therefore, represents a true production speed or velocity signal.

Modifying the true speed signal 100 to develop a control reference signal 103 is a high ratio, 10 turn for example, manually variable, 20 Kohm potentiometer 84. The gain result on the reference signal 103 is to alter the proportionality rate relationship between the frequency of pulses 99 and the magnitude of voltage arriving at the summing junction 86.

Figure 4:
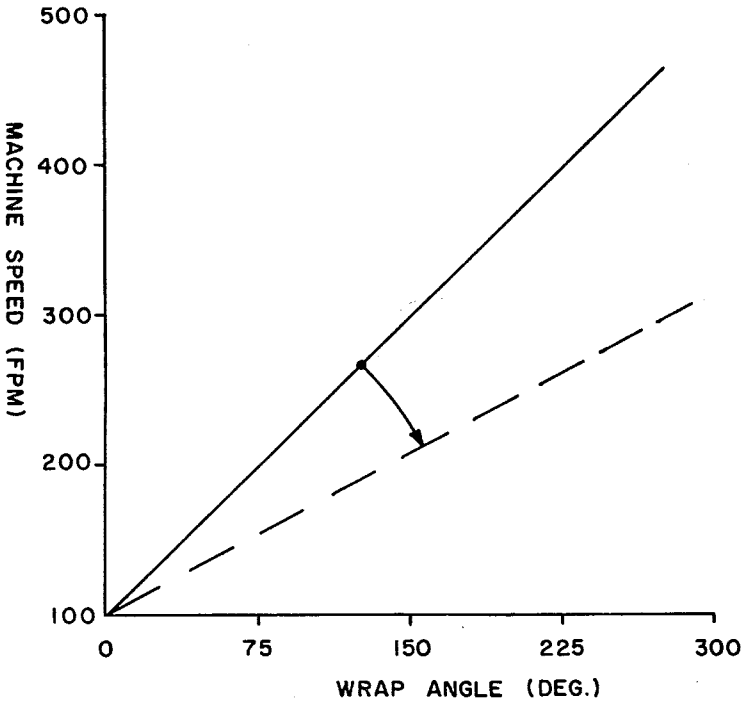
FIG. 4 is a graph of the effect a gain potentiometer in the speed signal circuit has on the present wrap guide roller control system response.

FIG. 4 graphically illustrates the isolated response effect of pot 84 on the overall machine operation; that being to alter the slope of the linear relationship between the machine speed and the angular degree of wrap the DFL and SFW are given about the respective preheating cylinders 20 and 30.

Figure 5:
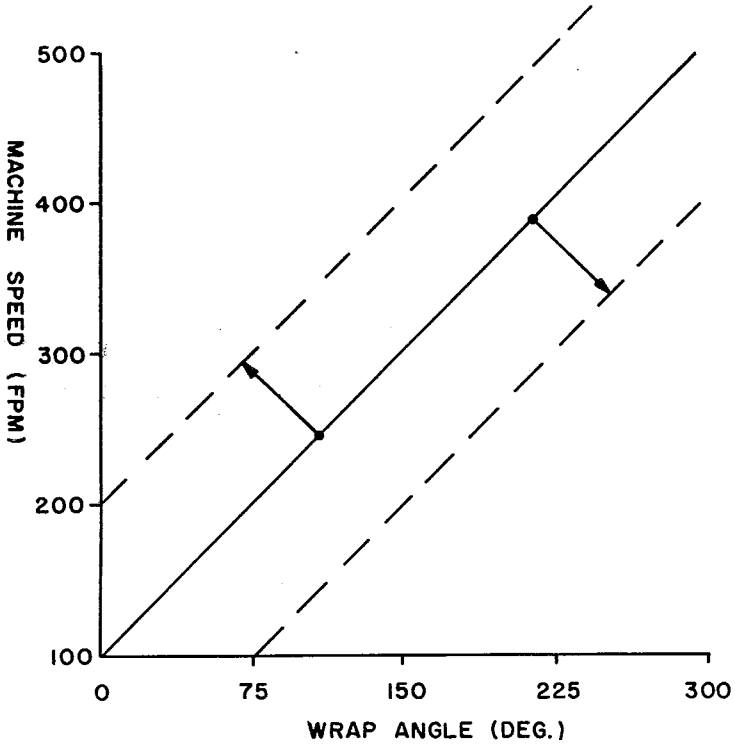
FIG. 5 is a graph of the effect a bias potentiometer in the speed signal circuit has on the present wrap guide roller control system response.

The variable gain speed signal 101 from pot 84 is transmitted to a summing junction 86 where it is combined with a manually variable bias signal 102 from another high resolution 20 Kohm potentiometer 85 in circuit with constant ±18 vdc reference voltages. The isolated response effect of bias signal 102 on the machine control is shown by FIG. 5 to be a constant value shift of the machine speed/angular degree of wrap relationship relative to the reference axis. In other words, the locus of the speed signal 101 is changed without altering the proportionality rate.

Relatively, the variable gain speed signal 101 may range from 0 to 10 vdc depending on the machine speed and the gain effect of pot 84. Over the range of 1–9 volts, this signal magnitude may be modified up to ±1 vdc by the summing junction 86 with the bias of signal 102 to emit a 0–10 vdc reference signal 103.

The weight range of the bias signal 102 has been empirically selected as 20 percent of the speed signal 101. In practice, this has been found to be a satisfactory relationship. It will be understood by those or ordinary skill in the art that the weight range of bias signal 102 could be as large as desired. However, if the range of signal 102 is greater than half of speed signal 101, an unnecessary loss of sensitivity will occur.

Deviation comparator 74 receives the reference signal 103 as a comparative for feedback signal 113 which is the derived summation of the wrap guide arm position signal 121 and the temperature signal 112.

Another feature of such well known subcircuit devices as deviation comparator 74 is an externally adjustable response deadband of up to 10 percent of the reference signal 103. Thus, if the magnitude of feedback signal 113 is within 10 percent of the reference signal 103 magnitude, no error signal 114 from the comparator 74 will issue.

A thermistor, pyrometer or other such electroresponsive temperature sensor 70 positioned adjacent (noncontacting) the bonding face of the DFL originates a raw signal 110 proportional over a very small current range to the face temperature of the DFL. This signal 110 is received and amplified by temperature monitor 71. A set-point signal 117 is generated in this device corresponding to the desired bonding temperature of 210° F. The device compares the amplified version of signal 110 and the internal set-point signal 117. If the comparison indicates a temperature deviation beyond the acceptable range of ±5° F. then monitor 71 emits an appropriate signal 111. For the purpose of trimming and calibrating, a 20 Kohm pot 72 is provided in the circuit of the final temperature signal 112 which has a variable value in the range ±1 vdc.

The position signal 121 originates from a single turn, 2.5 Kohm pot 90 impressed with an 18 vdc power source with the slider mechanically linked to the wrap guide arms 33 and 34. This mechanical linkage is schematically represented in FIG. 3 by the dotted line connection of pot 90 with component unit 79 which encompasses the arms 33, 34 and all power transmission drive components between the arm drive motor 78 and the pot slider. Proportional to the operating arc of the guide arms, 250° for example, signal 120 will vary 0 to 18 vdc. High resolution 20 Kohm pot 91 is provided for calibration and trim of the circuit so that a more appropriate proportional signal of 0 to 10 vdc may be delivered to summing junction 73 for the derivation of feedback signal 113.

Position signal 121 should provide the dominant control proportion of feedback signal 113. Since a relatively fixed relationship between machine speed, wrap guide arm position and temperature has been presumed, only a slight weighting effect on the presumption is necessary for an actual temperature measurement to maintain the desired operating result. Consequently, the range of temperature signal 112 should be less than half of the position signal 121 range. For the present example, the proportionality is selected at 20 percent.

The polarity of difference between the reference signal 103 and the feedback signal 113 is discerned by either of two parallel diodes 77. That diode corresponding to the polarity of difference between signal 103 and 113 will conduct the error signal differential 114 along the appropriate path of parallel conductors to a relay module 75. The relay module 75 functions to conduct greater electrical power 115 to the motor starting relay 76. The polarity of signal 114 differential determined by diodes 77 consequently determines whether the wrap guide arm motor will be commanded in the forward or reverse direction.

From the starting relay 75, running power 115 is conducted to the windings of wrap guide arm motor 78 which drives the arms 33 and 34 toward the required position. Simultaneous with the arm movement, feedback pot 90, the slider of which is mechanically linked to the arms 33, 34, is changing the character of position signal 121 and hence, feedback signal 113. When the arms 33, 34 have advanced sufficiently to cause a feedback signal 113 equal to reference signal 103, the differential magnitude and hence, polarity, of error signal 114 ceases, thereby opening the relays of module 75 and stopping the arm drive motor 78.

Having fully disclosed my invention, I claim:

1. An apparatus for laminating a polymer plastic coated liner web surface to flute tip surfaces of a polymer plastic coated, single faced, corrugated web comprising:

means for heating said flute tip surfaces and one surface side of said liner web to a tacky state of said polymer plastic coatings;

a bonding nip between an endless belt carrying pulley and a cylindrical roller located along a continuous traveling route of said webs at a junction point therebetween whereat said heated liner web side is joined with said heated flute tip surfaces;

pneumatic spring means for resiliently holding said roller against said nip;

pressure control means for selectively changing the resilient holding force of said spring means; and, jack means between said roller and said spring means to selectively adjust the opening of said bonding nip.

2. An apparatus as described by claim 1 wherein said roller has a hollow interior fluid circulation conduit connected with said roller interior and chilled water circulation means for circulating chilled water through said interior.

3. An apparatus as described by claim 2 comprising air table means adjacent said roller for supporting double faced board product emerging from said bonding nip on a dynamic air cushion against said endless belt.

* * * * *